United States Patent [19]

Billingsley et al.

[11] Patent Number: 4,779,598

[45] Date of Patent: Oct. 25, 1988

[54] ACCELERATION FUEL ENRICHMENT SYSTEM FOR AN INTERNAL COMBUSTION ENGINE

[75] Inventors: Henry C. Billingsley, Kenosha, Wis.; Peter Dogadko, Chicago, Ill.; Geoffrey S. Zgorzelski, Kenosha, Wis.

[73] Assignee: Outboard Marine Corporation, Waukegan, Ill.

[21] Appl. No.: 96,611

[22] Filed: Sep. 11, 1987

[51] Int. Cl.[4] ..... F02D 41/10; F02M 51/00

[52] U.S. Cl. ..... 123/492; 123/73 A; 123/438

[58] Field of Search ..... 123/299, 320, 330, 331, 123/73 A, 438, 478, 492

[56] References Cited

U.S. PATENT DOCUMENTS

| | | | |
|---|---|---|---|
| 3,719,176 | 3/1973 | Shinoda et al. | 123/492 |
| 3,858,561 | 1/1975 | Aono | 123/492 |
| 4,010,717 | 3/1977 | Taplin | 123/492 |
| 4,466,412 | 8/1984 | McChesney et al. | 123/492 |
| 4,498,434 | 2/1985 | Baltz et al. | 123/187.5 R |
| 4,508,068 | 4/1985 | Tuggle et al. | 123/187.5 R |
| 4,542,726 | 9/1985 | Baltz et al. | 123/320 |
| 4,548,181 | 10/1985 | Ishikawa et al. | 123/492 |
| 4,561,404 | 12/1985 | Kanno et al. | 123/492 |

*Primary Examiner*—Willis R. Wolfe

*Attorney, Agent, or Firm*—Michael, Best & Friedrich

[57] ABSTRACT

An engine apparatus comprising an internal combustion engine operable throughout a range of speeds including a minimum speed, a maximum speed, a first speed between the minimum speed and the maximum speed, and a second speed between the first speed and the maximum speed, the engine including an intake zone wherein relatively low pressure is created in response to engine operation, a primary fuel delivery system for delivering fuel from a fuel source to the engine for normal engine operation, a selectively actuatable secondary fuel delivery system for delivering enrichment fuel from a fuel source to the engine, and an electrical control circuit for selectively actuating the secondary fuel delivery system only when the pressure in the zone is below a predetermined level and the speed of the engine is above the first speed and below the second speed.

21 Claims, 1 Drawing Sheet

ACCELERATION FUEL ENRICHMENT SYSTEM FOR AN INTERNAL COMBUSTION ENGINE

BACKGROUND OF THE INVENTION

The invention relates to fuel supply systems for internal combustion engines, and, more particularly, to such fuel supply systems for providing enrichment fuel during engine operation. Still more particularly, the invention relates to such fuel supply systems used with marine propulsion devices.

During high speed turns, the propeller of a marine propulsion device may lose its "grip" on the water, thereby causing the engine to race or climb to a high rpm range. This in turn causes nearly instantaneous vaporization of residual fuel in the engine crankcase. When the engine is slowed from a high rpm range to a lower rpm range in order to allow the propeller to regain its "grip", and then quick acceleration is attempted, this vaporization of the residual fuel can result in stalling of the engine.

The engine can also have an inadequate fuel supply when it is quickly accelerated from idle to wide-open throttle.

Attention is directed to the following U.S. Pat. Nos.:
McChesney, et al.; 4,466,412 Aug. 21, 1984
Baltz, et al.; 4,4,498,434 Feb. 12, 1985
Tuggle, et al.; 508,068 Apr. 2, 1985
Baltz, et al.; 4,542,726 Sept. 24, 1985
Ishikawa, et al.; 4,548,181 Oct. 22, 1985
Kanno, et al.; 4,561,404 Dec. 31, 1985

SUMMARY OF THE INVENTION

The invention provides an engine apparatus comprising an internal combustion engine operable throughout a range of speeds including a minimum speed, a maximum speed, a first speed between the minimum speed and the maximum speed, and a second speed between the first speed and the maximum speed, a primary fuel delivery system for delivering fuel from a fuel source to the engine for normal engine operation, a selectively actuatable secondary fuel delivery system for delivering enrichment fuel from a fuel source to the engine, and means for selectively actuating the secondary fuel delivery system only when the speed of the engine is above the first speed and below the second speed.

In one embodiment, the engine includes means defining a zone wherein relatively low pressure is created in response to engine operation, and the actuating means actuates the secondary system only when the pressure in the zone is below a predetermined level.

In one embodiment, the secondary fuel delivery system includes electrically actuated means for delivering fuel to the engine, and the actuating means includes an electrical control circuit.

In one embodiment, the electrical control circuit includes a source of electrical energy, and means for connecting the source to the electrically actuated means only when the pressure in the zone is below the predetermined level and the engine speed is above the first speed and below the second speed.

In one embodiment, the connecting means includes first and second switch means serially connected between the electrically actuated means and the source, means for closing the first switch means only when the pressure in the zone is below the predetermined level, and means for closing the second switch means only when the engine speed is above the first speed and below the second speed.

In one embodiment, the means for closing the second switch means includes means for developing a voltage indicative of engine speed, and means for closing the second switch means only when the voltage is above a first level corresponding to the first speed and below a second level corresponding to the second speed.

In one embodiment, the means for closing the second switch means when the voltage is above the first level and below the second level includes a first comparator for comparing the voltage to the first level, and a second comparator for comparing said voltage to the second level.

In one embodiment, the engine apparatus further comprises operator actuatable means for starting the engine, and means for actuating the secondary fuel delivery system when the starting means is actuated.

The invention also provides an engine apparatus comprising an internal combustion engine operable throughout a range of speeds including a minimum speed, a maximum speed, a first speed between the minimum speed and the maximum speed, and a second speed between the first speed and the maximum speed, the engine including means defining a zone wherein relatively low pressure is created in response to engine operation, means for delivering fuel from a fuel source to the engine, and an electrical control circuit for selectively actuating the fuel delivering means only when the pressure in the zone is below a predertermined level and the speed of the engine is above the first speed and below the second speed.

The invention also provides an engine apparatus comprising an internal combustion engine operable throughout a range of speeds including a minimum speed, a maximum speed, a first speed between the minimum speed and the maximum speed, and a second speed between the first speed and the maximum speed, the engine including means defining a zone wherein relatively low pressure is created in response to engine operation, a primary fuel delivery system for delivering fuel from a fuel source to the engine for normal engine operation, a selectively actuatable secondary fuel delivery system for delivering enrichment fuel from a fuel source to the engine, the secondary fuel delivery system including electrically actuated means for delivering fuel to the engine, a source of electrical energy, first and second switch means serially connected between the electrically actuated means and the source, means for closing the first switch means only when the pressure in the zone is below the predetermined level, means for developing a voltage indicative of engine speed, and means for closing the second switch means only when the voltage is above a first level corresponding to the first speed and below a second level corresponding to the second speed.

A principal feature of the invention is the provision of means for selectively activating a secondary or enrichment fuel delivery system when the engine speed is within a range above minimum speed and below maximum speed, and preferably when the engine intake pressure is below a predetermined level.

Another principal feature of the invention is the provision of an electrical control circuit for selectively activating an enrichment fuel delivery system only when the engine intake pressure is below a predetermined level and the engine speed is within a range above minimum speed and below maximum speed.

Another principal feature of the invention is the provision of such an electrical control circuit including a source of electrical energy, first and second switch means serially connected between the source and an electrically actuated enrichment fuel delivery system, means for closing the first switch means when the fuel intake pressure is below a predetermined level, means for developing a voltage indicative of engine speed, and means for closing the second switch means when the voltage is within a range above minimum voltage and below maximum voltage.

Other features and advantages of the invention will become apparent to those skilled in the art upon review of the following detailed description, claims, and drawings.

Figure 1:
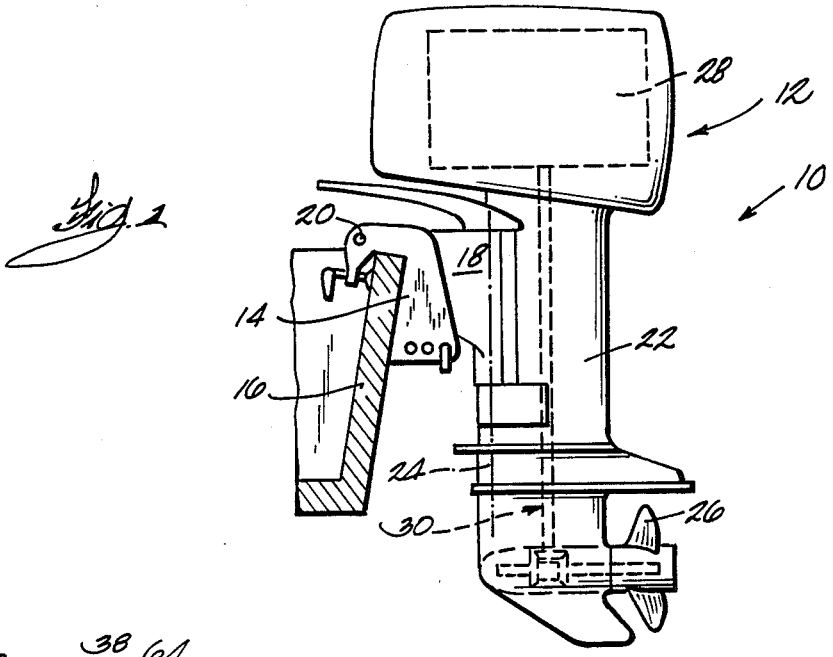
FIG. 1 is a side elevational view, partially in section, of a marine installation embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
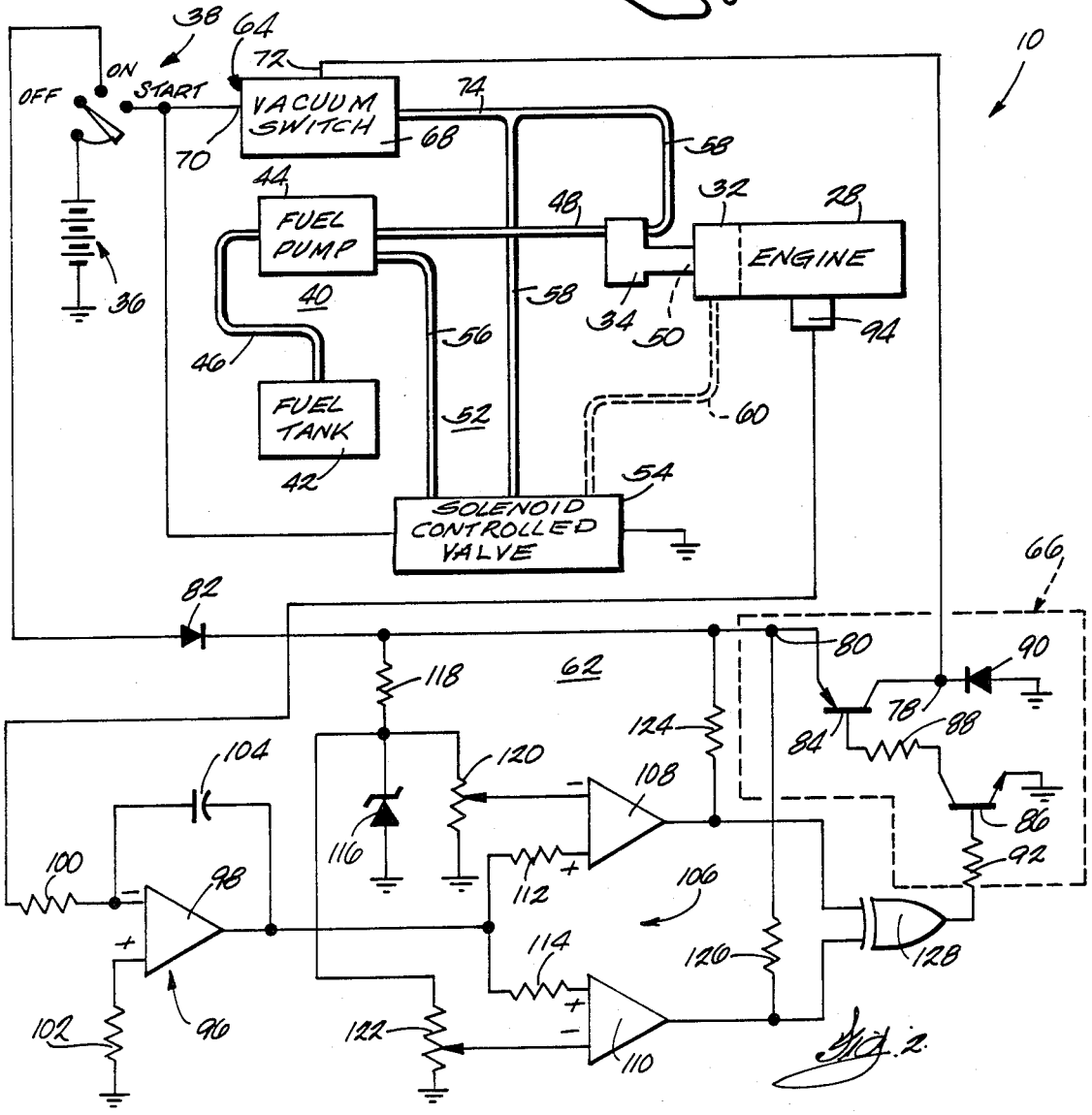
FIG. 2 is a schematic view of an engine apparatus which is part of the marine installation.

A marine installation 10 embodying the invention is illustrated in FIGS. 1 and 2 and comprises a marine propulsion device 12. While the illustrated marine propulsion device 12 is an outboard motor, it should be understood that the marine propulsion device 12 could also be a stern drive unit or another type of marine propulsion device.

The marine propulsion device 12 comprises a transom bracket 14 fixedly mounted on the transom 16 of a boat, and a swivel bracket 18 mounted on the transom bracket 14 for a pivotal movement relative thereto about a generally horizontal tilt axis 20. The marine propulsion device 12 also comprises a propulsion unit 22 mounted on the swivel bracket 18 for pivotal movement relative thereto about a generally vertical steering axis 24. The propulsion unit 22 includes a rotatably mounted propeller 26, and an engine 28 drivingly connected to the propeller 26 via a conventional drive train 30. The engine 28, which is preferably a two-stroke internal combustion engine, is operable throughout a range of speeds between a minimum speed and a maximum speed. As shown schematically in FIG. 2, in the preferred embodiment, the engine 28 includes an intake manifold 32, and a carburetor 34 connected to the intake manifold 32 and having therein a throttle plate (not shown). This arrangement is conventional and will not be described in greater detail. For a more detailed description of such an engine, see U.S. Pat. No. 4,542,726, issued Sept. 24, 1985, which is hereby incorporated by reference.

The marine installation 10 also comprises a conventinal ignition system including a battery 36, and an ignition switch 38 moveable between "on," "off," and "start" positions. The ignition switch 38 constitutes operator actuatable means for starting the engine 28.

The marine isntallation 10 also comprises a primary fuel delivery system 40 for delivering fuel from a fuel source 42 to the engine 28 for normal engine operation. While various suitable systems can be employed, in the preferred embodiment, the primary fuel delivery system 40 includes a conventional fuel pump 44 which can be operated electrically or by pulsating engine pressures. Such a fuel pump is described in the above-mentioned U.S. Pat. No. 4,542,726. The fuel pump 44 is connected to the fuel source or fuel tank 42 via a conduit 46 and delivers fuel to the carburetor 34 via a primary fuel supply conduit 48.

Both the intake manifold 32 and the region of the carburetor 34 downstream of the throttle plate define a zone 50 wherein relatively low pressure is created in response to engine operation. As explained previously, when the engine 28 is quickly accelerated from idle (a first speed that is above the minimum speed) to wide-open throttle, or when the engine 28 is decelerated from the high rpm range to a lower rpm range (below a second speed that is below the maximum speed) and then quickly accelerated, the pressure in this zone 50, i.e., the intake pressure, can become lower than normal. This lower-than-normal pressure can result in engine stalling.

Accordingly, the marine installation 10 further comprises a selectively actuatable secondary fuel delivery system 52 for delivering enrichment fuel from a fuel source to the engine 28, and means for selectively actuating the secondary fuel delivery system 52 only when the pressure in the engine zone 50 is below a predetermined level and the speed of the engine 28 is above the above-mentioned first speed and below the above-mentioned second speed.

While various suitable secondary fuel delivery systems can be used, in the illustrated construction, the secondary fuel delivery system 52 includes electrically actuated means for delivering fuel to the engine 28. In the preferred embodiment, the electrically actuated means includes a conventional solenoid controlled valve 54. A suitable solenoid controlled valve is disclosed in the above-mentioned U.S. Pat. No. 4,542,726. The solenoid controlled valve 54 is connected to the fuel pump 44 via a conduit 56, and is connected to the carburetor 34 via a secondary fuel supply conduit 58. In alternative arrangements, the solenoid controlled valve 54 can be connected to the intake manifold 32 via a conduit 60 (shown in dotted lines in FIG. 2) rather than to the carburetor 34.

While various suitable actuating means can be used, in the preferred embodiment, this means includes an electrical control circuit 62. While various suitable control circuits can be employed, in the illustrated construction, the control circuit 62 includes a source of electrical energy, and means for connecting the source to the solenoid controlled valve 54 only when the pressure in the engine zone 50 is below the predetermined level and the engine speed is above the first speed and below the second speed.

In the preferred embodiment, the source of electrical energy is the battery 36. While various suitable means can be employed for connecting the battery 36 to the solenoid controlled valve 54, in the preferred embodiment, the connecting means includes first and second switch means 64 and 66, respectively, serially connected between the solenoid controlled valve 54 and the battery 36, means for closing the first switch means 64 only when the pressure in the engine zone 50 is below the predetermined level, and means for closing the second switch means 66 only when the engine speed is above the first speed and below the second speed.

While various suitable first switch means 64 and means for closing the first switch means 64 can be used, in the illustrated construction, such means include a conventional vacuum switch 68 having a first terminal 70 connected to the solenoid controlled valve 54 and a second terminal 72 connected to the second switch means 66. Also, the vacuum switch 68 is connected to the carburetor 34 or engine zone 50 via a conduit 74 connected to the secondary fuel supply conduit 58. The vacuum switch 68 is normally open and closes when the pressure in the engine zone 50 is below the predetermined level. Such a vacuum switch is disclosed in the above mentioned U.S. Pat. No. 4,542,726.

While various suitable second switch means 66 can be used, in the illustrated construction, the second switch means 66 includes an electronic switch having a first terminal 78 connected to the second terminal 72 of the vacuum switch 68, and a second terminal 80 connected to the "on" terminal of the ignition switch 38 through a normally forwardly biased diode 82. To selectively make and break electrical continuity between the terminals 78 and 80 of the electronic switch 66, the electronic switch includes a PNP transistor 84 having its collector connected to the first terminal 78 and its emitter connected to the second terminal 80. The base of the PNP transistor 84 is coupled through a resistor 88 to the collector of an NPN transistor 86 having its emitter connected to circuit ground. The base of the NPN transistor 86 is connected to one end of a resistor 92, and a normally reverse biased diode 90 is connected between the first terminal 78 and circuit ground. As so connected, a positive polarity voltage applied to the other end of the resistor 92 biases the NPN transistor 86 on with the further effect that the PNP transistor 84 is driven into saturation. This has the effect of establishing electrical continuity between the first and second terminals 78 and 80. Similarly, a low voltage at the other end of the resistor 92 biases the NPN transistor 86 off, with further effect that the PNP transistor breaks electrical continuity between the terminals 78 and 80.

While various suitable means can be used for closing the second switch means or electronic switch 66 when the engine speed is above the first speed and below the second speed, in the illustrated construction, such means includes engine speed sensing means for developing a voltage indicative of engine speed, and means for closing the second switch means 66 only when the voltage is above a first level corresponding to the first speed and below a second level corresponding to the second speed. Preferably, the voltage developing means includes a conventional tachometer 94 which produces electrical pulses indicative of engine speed, and an integrator 96 which is connected to the tachometer and which converts the electrical pulses into a voltage that is proportional to the rpm of the engine 28. In the preferred embodiment, the means for closing the second switch means 66 when the voltage is above the first level and below the second level includes a dual threshold or "window" voltage comparator 106 having a first comparator section for comparing the voltage to the first level, and a second comparator section for comparing the voltage to the second level. When the voltage is above the first level and below the second level, the window comparator 106 produces a signal which closes the second switch means 66.

As illustrated, the integrator 96 includes an operational amplifier 98 having its inverting input coupled to the engine tachometer 94 through a resistor 100 and having its non-inverting input coupled to circuit ground through a resistor 102. The output of the operational amplifier 98 is coupled to the inverting input through a capacitor 104. When so connected, the integrator 96 integrates the speed-indicative pulses developed by the tachometer, and the voltage at the output of the operational amplifier 98 is substantially proportional to engine speed.

To provide an indication of when the engine speed is above the first speed and below the second speed, the dual threshold or window voltage comparator 106 includes first and second operational amplifiers 108 and 110, respectively. As illustrated, the output of the integrator 96 is coupled through a resistor 112 to the non-inverting input of the first operational amplifier 108 and through a resistor 114 to the non-inverting input of the second operational amplifier 110. A basic reference voltage is established by means of a zener diode 116 and a resistor 118 serially connected between the cathode of diode 82 and circuit ground. As so connected, the zener diode 116 functions to provide a constant, stable, reference voltage at the juncture of the zener diode 116 and the resistor 118. Additional reference voltages, for establishing the first and second voltage levels corresponding to the first and second engine speeds, are provided by means of first and second potentiometers 120 and 122, respectively, which are connected in parallel across the zener diode 116. The wiper of the first potentiometer 120 is connected to the inverting input of the first operational amplifier 108, and the wiper of the second potentiometer 122 is connected to the inverting input of the second operational amplifier 110. When so connected, the basic reference voltage established across the zener diode is independently divided by each of the first and second potentiometers 120 and 122. Thus, the voltage on the inverting input of the first operational amplifier 108 is constant and is determined by the position of the wiper of the first potentiometer 120. Similarly, the voltage at the inverting input of the second operational amplifier 110 is determined by the setting of the second potentiometer 122. Thus, by adjusting the potentiometers 120 and 122, the voltages at the inverting inputs of the first and second operational amplifiers 108 and 110 can be independently adjusted.

The output of the first operational amplifier 108 is coupled through a pull-up resistor 124 to the cathode of the diode 82, and the output of the second operational amplifier 110 is coupled through an additional pull-up resistor 126 to the cathode of diode 82. The output of the first and second operational amplifiers 108 and 110, respectively, are also individually connected to the inputs of a two-input exclusive OR-gate 128. When so connected, the output of the first operational amplifier 108 will be high when the output voltage of the integrator 96 is greater than the reference voltage established by the first potentiometer 120, and will be low when the output voltage of the integrator is less than the reference voltage established by the first potentiometer 120. Similarly, the output of the second operational amplifier will be high when the output voltage of the integrator 96 is greater than the reference voltage established by the second potentiometer 122, and will be low when the output voltage of the integrator is less than the reference voltage established by the second potentiometer 122. By setting the reference voltage established by the first potentiometer 120 to be substantially equal to the voltage appearing at the output of the integrator when the engine is operating at the first speed, and by setting the second reference voltage established by the second potentiometer 122 to be substantially equal to the output voltage of the integrator 96 when the engine 28 is operating the second speed, the outputs of the first and second operational amplifiers 108 and 110 will be dissimilar only when the engine is operating between the first and second speeds. Thus, the output of the exclusive OR-gate 128 will be high only when the engine 28 is operating between the first and second speeds and will be low when the engine speed is either less than the first speed or greater than the second speed. The output of the exclusive OR-gate 128 is connected to the other end of the resistor 92. Accordingly, when the output of the exclusive OR-gate 128 is high, the transistor 84 is rendered conductive and the battery voltage is applied to the vacuum switch 68. When the output of the exclusive OR-gate 128 is low, the transistor 84 is rendered nonconductive and no battery voltage is applied to the vacuum switch 68 through the conductor 72. Accordingly, that battery voltage is applied to the vacuum switch 68 through the conductor 72 only when the speed of the engine 28 is greater than the first speed but less than the second speed.

While in the preferred embodiment the first switch means 64 is connected between the solenoid controlled valve 54 and the second switch means 66, it should be understood that in alternative embodiments the second switch means 66 can be connected between the solenoid controlled valve 54 and the first switch means 64. In other words, the order of the first and second switch means 64 and 66 between the battery 36 and the solenoid controlled valve 54 can be reversed.

The marine installation 10 preferably further comprises means for selectively actuating the secondary fuel delivery system 52 when the ignition switch 38 is in the "start" position. While various suitable actuating means can be used, in the preferred embodiment, the solenoid controlled valve 54 is connected to the "start" terminal of the ignition switch 38 so that the valve 54 is energized when the ignition switch 38 is in the "start" position, i.e., when the engine 28 is started. This arrangement is known in the art and is disclosed in the above mentioned U.S. Pat. No. 4,542,726. If desired, means for manually priming the engine 28 can also be provided.

Various features of the invention are set forth in the following claims.

We claim:

1. An engine apparatus comprising an internal combustion engine operable throughout a range of speeds including a minimum speed, a maximum speed, a first speed between said minimum speed and said maximum speed, and a second speed between said first speed and said maximum speed, a primary fuel delivery system for delivering fuel from a fuel source to said engine for normal engine operation, a selectively actuatable secondary fuel delivery system for delivering enrichment fuel from a fuel source to said engine, and means for sensing engine speed and for selectively actuating said secondary fuel delivery system only when the speed of said engine is above said first speed and below said second speed.

2. An engine apparatus as set forth in claim 1 wherein said engine includes means defining a zone wherein relatively low pressure is created in response to engine operation, and wherein said actuating means actuates said secondary fuel delivery system only when the pressure in said zone is below a predetermined level.

3. An engine apparatus as set forth in claim 2 wherein said secondary fuel delivery system includes electrically actuated means for delivering fuel to said engine, and wherein said actuating means includes an electrical control circuit connected to said electrically actuated means.

4. An engine apparatus as set forth in claim 3 wherein said electrical control circuit includes a source of electrical energy, and means for connecting said source to said electrically actuated means only when the pressure in said zone is below said predetermined level and the engine speed is above said first speed and below said second speed.

5. An engine apparatus comprising an internal combustion engine operable throughout a range of speeds including a minimum speed, a maximum speed, a first speed between said minimum speed and said maximum speed, and a second speed between said first speed and said maximum speed, said engine including a primary fuel delivery system for delivering fuel from a fuel source to said engine for normal engine operation, a selectively actuatable secondary fuel delivery system for delivering enrichment fuel from a fuel source to said engine, said secondary fuel delivery system including electrically actuated means for delivering fuel to said engine, means defining a zone wherein relatively low pressure is created in response to engine operation, and means for selectively actuating said secondary fuel delivery system, said actuating means including an electrical control circuit connected to said electrically actuated means and including a source of electrical energy, means for connecting said source of electrical energy to said electrically actuated means only when the pressure in said zone is below a predetermined level and the engine speed is above said first speed and below said second speed, and an ignition switch having a first terminal connected to said source of electrical energy, an "on" terminal connectable between said first terminal and said electrically actuated means, and a "start" terminal.

6. An engine apparatus comprising an internal combustion engine operable throughout a range of speeds including a minimum speed, a maximum speed, a first speed between said minimum speed and said maximum speed, and a second speed between said first speed and said maximum speed, a primary fuel delivery system for delivering fuel from a fuel source to said engine for normal engine operation, a selectively actuatable secondary fuel delivery system for delivering enrichment fuel from a fuel source to said engine, said secondary fue1 delivery system including electrically actuated means for delivering fuel to said engine, means defining a zone wherein relatively low pressure is created in response to engine operation, and measn for selectively actuating said secondary fuel delivery system, first and second switch means serially connected between said electrically actuated means and said source of electrical energy, means for closing said first switch means only when the pressure in said zone is below said predetermined level, and means for closing said second switch means only when the engine speed is above said first speed and below said second speed.

7. An engine apparatus as set forth in claim 6 and further comprising an ignition switch having a terminal connected to said source, an "on" terminal, and a "start" terminal, and wherein said first and second switch means are serially connected between said electrically actuated means and said "on" terminal.

8. An engine apparatus as set forth in claim 6 wherein said means for closing said second switch means includes means for developing a voltage indicative of engine speed, and means for closing said second switch means only when said voltage is above a first level corresponding to said first speed and below a second level corresponding to said second speed.

9. An engine apparatus as set forth in claim 8 wherein said means for closing said second switch means when said voltage is above said first level and below said second level includes a first comparator for comparing said voltage to said first level, and a second comparator for comparing said voltage to said second level.

10. An engine apparatus as set forth in claim 1 and further comprising operator actuatable means for starting said engine, and means for actuating said secondary fuel delivery system when said starting means is actuated.

11. An engine apparatus as set forth in claim 10 wherein said operator actuatable means includes an ignition switch having a terminal connected to a source of electrical energy, an "on" terminal, and a "start" terminal, and wherein said secondary fuel delivery system includes electrically actuated means connected to said "start" terminal.

12. An engine apparatus comprising an internal combustion engine operable throughout a range of speeds including a minimum speed, a maximum speed, a first speed between said minimum speed and said maximum speed, and a second speed between said first speed and said maximum speed, said engine including means defining a zone wherein relatively low pressure is created in response to engine operation, means for delivering fuel from a fuel source to said engine, and an electrical control circuit including means for sensing engine speed and for selectively actuating said fuel delivering means only when the pressure in said zone is below a predetermined level and the speed of said engine is above said first speed and below said second speed.

13. An engine apparatus as set forth in claim 12 wherein said fuel delivering means includes electrically actuated means for delivering fuel to said engine, and wherein said electrical control circuit includes a source of electrical energy, and means for connecting said source to said electrically actuated means only when the pressure in said zone is below said predetermined level and the engine speed is above said first speed and below said second speed.

14. An engine apparatus comprising an internal combustion engine operable throughout a range of speeds including a minimum speed, a maximum speed, a first speed between said minimum speed and said maximum speed, and a second speed between said first speed and said maximum speed, said engine including means defining a zone wherein relatively low pressure is created in response to engine operation, means for delivering fuel from a fuel source to said engine, said fuel delivering means including electrically actuated means for delivering fuel to said engine, and an electrical control circuit for selectively actuating said fuel delivering means and including a source of electrical energy, and means for connecting sasid source of electrical energy to said electrically actuated means only when the pressure in said zone is below said predetermined level and the engine speed is aboe said first speed and below said second speed, and an ignition switch having a first terminal connected to said source of electrical energy, an "on" terminal connectable between said first terminal and said electrically actuated means, and a "start" terminal.

15. An engine apparatus comprising an internal combustion engine operpable throughout a range of speeds including a minimum speed, a maximum speed, a first speed between said minimum speed and said maximum speed, and a second speed between said first speed and said maximum speed, said engine including means defining a zone wherein relatively low pressure is created in response to engine operation, said fuel delivering means including electrically actuated means for delivering fuel to said engine, means for delivering fuel from a fuel source to said engine, said fuel delivering means including electrically actuated means for delivering fuel to said engine, and an electrical control circuit for selectively actuating said fuel delivering means and including a source of electrical energy, and means for connecting said source to said electrically actuated means and including first and second switch means serially connected between said electrically actuated means and said source of electrical energy, means for closing said first switch means only when the pressure in said zone is below said predetermined level, and means for closing said second switch means only when the engine speed is above said first level and below said second level.

16. An engine apparatus as set forth in claim 15 and further comprising an ignition switch having a terminal connected to said source, an "on" terminal, and a "start" terminal, and wherein said first and eeocnd switch means are serially connected between said electrically actuated means and said "on" terminal.

17. An engine apparatus as set forth in claim 15 wherein said means for closing said second switch means includes means for developing a voltage indicative of engine speed, and means for closing said second switch means only when said voltage is above a first level corresponding to said first speed and below a second level corresponding to said second speed.

18. An engine apparatus as set forth in claim 17 wherein said means for closing said second switch means when said voltage is above said first level and below said second level includes a first comparator for comparing said voltage to said first level, and a second comparator for comparing said voltage to said second level.

19. An engine apparatus comprising an internal combustion engine operable throughout a range of speeds including a minimum speed, a maximum speed, a first speed between said minimum speed and said maximum speed, and a second speed between said first speed and said maximum speed, said engine including means defining a zone wherein relatively low pressure is created in response to engine operation, a primary fuel delivery system for delivering fuel from a fuel source to said engine for normal engine operation, a selectively actuatable secondary fuel delivery system for delivering enrichment fuel from a fuel source to said engine, said secondary fuel delivery system including electrically actuated means for delivering fuel to said engine, a source of electrical energy, first and second switch means serially connected between said electrically actuated means and said source, means for closing said first switch means only when the pressure in said zone is below said predetermined level, means for developing a voltage indicative of engine speed, and means for closing said second switch means only when said voltage is above a first level corresponding to said first speed and below a second level corresponding to said second speed.

20. An engine apparatus as set forth in claim 19 and further comprising an ignition switch having a terminal connected to said source, an "on" terminal, and a "start" terminal, and wherein said first and second switch means are serially connected between said electrically actuated means and said "on" terminal.

21. An engine apparatus comprising an internal combustion engine operable throughout a range of speeds including a minimum speed, a maximum speed, a first speed between said minimum speed and said maximum speed, and a second speed between said first speed and said maximum speed, a selectively actuatable fuel delivery system for delivering enrichment fuel from a fuel source to said engine, and an electrical control circuit including means for sensing engine speed and for selectively actuating said fuel delivery system only when the speed of said engine is above said first speed and below said second speed.

* * * * *